US011569016B2

(12) United States Patent
Dams

(10) Patent No.: US 11,569,016 B2
(45) Date of Patent: Jan. 31, 2023

(54) COIL ASSEMBLY FOR MAGNETIC ACTUATOR, MAGNETIC ACTUATOR AND MANUFACTURING METHOD

(71) Applicant: Magnetic Innovations B.V., Veldhoven (NL)

(72) Inventor: Johannes Adrianus Antonius Theodorus Dams, Veldhoven (NL)

(73) Assignee: MAGNETIC INNOVATIONS B.V., Veldhoven (NL)

( * ) Notice: Subject to any disclaimer, the term of this patent is extended or adjusted under 35 U.S.C. 154(b) by 0 days.

(21) Appl. No.: 16/968,802

(22) PCT Filed: Feb. 11, 2019

(86) PCT No.: PCT/NL2019/050085
§ 371 (c)(1),
(2) Date: Aug. 10, 2020

(87) PCT Pub. No.: WO2019/156564
PCT Pub. Date: Aug. 15, 2019

(65) Prior Publication Data

US 2021/0012938 A1 Jan. 14, 2021

(30) Foreign Application Priority Data

Feb. 12, 2018 (NL) ..... 2020418

(51) Int. Cl.
*H01F 7/08* (2006.01)
*H01F 7/02* (2006.01)
(Continued)

(52) U.S. Cl.
CPC ..... *H01F 7/081* (2013.01); *H01F 7/02* (2013.01); *H01F 7/064* (2013.01); *H01F 7/126* (2013.01);
(Continued)

(58) Field of Classification Search
CPC ..... H01F 2005/022; H01F 2007/1692; H01F 41/061; H01F 5/04; H01F 7/02;
(Continued)

(56) References Cited

U.S. PATENT DOCUMENTS 3,230,489 A * 1/1966 Weyrich ..... H01F 5/04 336/192
3,461,413 A * 8/1969 Wood ..... H01F 5/04 336/84 R
(Continued)

FOREIGN PATENT DOCUMENTS

CN 206774383 U 12/2017
DE 2113895 A1 9/1972
EP 1158547 A2 11/2001

*Primary Examiner* — Bernard Rojas
(74) *Attorney, Agent, or Firm* — Browdy and Neimark, PLLC

(57) ABSTRACT

A coil assembly for a magnetic actuator is described, the coil assembly comprising: —a tubular coil holder (100) comprising a first (110) and second open distal end (120); —the first open distal end comprising an outer circular rim (112) and an inner circular rim (114) separated by a circular groove (116); —the second open distal end comprising an outer circular rim (122); the tubular coil holder further comprising a central circular rim (130) arranged substantially halfway between the inner circular rim of the first open distal end and the outer circular rim of the second open distal end; —a coil (140) formed of a single wire (150) the coil comprising a first coil section (142) arranged in a first winding area (144) between the inner circular rim of the first open distal end and the central circular rim, and a second coil section (146) in a second winding area (148) between the central circular rim and the outer circular rim of the second distal end; the first coil section and the second coil section being wound about the tubular coil holder in opposite directions; whereby a first end (152) and a second end (154)
(Continued)

of the single wire are arranged in the circular groove, the inner circular rim comprising a longitudinal groove (114.1) to extend the first aid and the second end of the single wire from the circular groove to the first winding area; the central circular rim composing a longindinal groove (130.1) to extend the single wire form the first winding area to the second winding area and vice versa; —an external connection (160) comprising a first conductor (162) and a second conductor (164); whereby an end of the first conductor is electrically connected to the first end of the single wire so as to form a first electrical connection (166) arranged in the circular groove and an end of the second conductor is electrically connected to the second end of the single wire so as to form a second electrical connection (168) in the circular groove and wherein the first and second conductor extend through the outer circular rim via a longitudinal groove (112.1) of the outer circular rim.

27 Claims, 6 Drawing Sheets

(51) Int. Cl.
*H01F 7/06* (2006.01)
*H01F 41/061* (2016.01)
*H01F 7/126* (2006.01)
*H01F 7/128* (2006.01)
*H01F 7/16* (2006.01)

(52) U.S. Cl.
CPC ..... *H01F 7/128* (2013.01); *H01F 7/1615* (2013.01); *H01F 41/061* (2016.01)

(58) Field of Classification Search
CPC ..... H01F 7/064; H01F 7/081; H01F 7/126; H01F 7/128; H01F 7/1615
See application file for complete search history.

(56) References Cited

U.S. PATENT DOCUMENTS

| | | | | |
|---|---|---|---|---|
| 3,559,134 | A | 1/1971 | Daley | |
| 6,176,207 | B1 | 1/2001 | Wright et al. | |
| 8,415,838 | B1 | 4/2013 | Eghbal et al. | |
| 2001/0017581 | A1* | 8/2001 | Suda | H01F 7/06 335/299 |
| 2003/0094535 | A1* | 5/2003 | Schmidt | H01F 5/04 242/603 |
| 2015/0015352 | A1* | 1/2015 | Satou | H01F 7/1615 335/229 |
| 2015/0267661 | A1 | 9/2015 | Namuduri et al. | |
| 2015/0267800 | A1 | 9/2015 | Phillips et al. | |
| 2017/0256348 | A1 | 9/2017 | Thode et al. | |

* cited by examiner

COIL ASSEMBLY FOR MAGNETIC ACTUATOR, MAGNETIC ACTUATOR AND MANUFACTURING METHOD

FIELD OF THE INVENTION

The invention relates to the field of electromagnetic actuators, in particular to the field of magnetic actuators having a tubular coil assembly into which a cylindrical magnet assembly is arranged.

BACKGROUND OF THE INVENTION

The present invention relates to the field of electromagnetic actuators, in particular to the field of manufacturing or assembling processes for such actuators. Known manufacturing and assembling methods of comparatively small actuators may be complicated and therefore rather expensive or impossible to utilize for substantial production quantities. This limits the application of such actuators in technological fields where cost-of-goods play an important role.

SUMMARY OF THE INVENTION

It would be desirable to provide an electromagnetic actuator that can be more easily manufactured or assembled than known actuators of similar topology/size.

To better address one or more of these concerns, in a first aspect of the invention, there is provided a coil assembly for a magnetic actuator, the coil assembly comprising:

a tubular coil holder (100) comprising a first (110) and second open distal end (120);

the first open distal end comprising an outer circular rim (112) and an inner circular rim (114) separated by a circular groove (116);

the second open distal end comprising an outer circular rim (122);

a coil (140) formed of a single wire (150), the coil being arranged in a winding area between the inner circular rim of the first open distal end and the outer circular rim of the second distal end; whereby a first end (152) and a second end (154) of the single wire are arranged in the circular groove; the inner circular rim comprising a longitudinal groove (114.1) to extend the first end and the second end of the single wire from the circular groove to the first winding area;

an external connection (160) comprising a first conductor (162) and a second conductor (164); whereby an end of the first conductor is electrically connected to the first end of the single wire so as to form a first electrical connection (166) arranged in the circular groove and an end of the second conductor is electrically connected to the second end of the single wire so as to form a second electrical connection (168) in the circular groove and wherein the first and second conductor extend through the outer circular rim via a longitudinal groove (112.1) of the outer circular rim.

Instead of having one winding area, the coil assembly may also comprise two or more winding areas. As such, according to an aspect of the present invention, there is provided a coil assembly for a magnetic actuator, the coil assembly comprising:

a tubular coil holder (100) comprising a first (110) and second open distal end (120);

the first open distal end comprising an outer circular rim (112) and an inner circular rim (114) separated by a circular groove (116);

the second open distal end comprising an outer circular rim (122);

the tubular coil holder further comprising one or more circular rims (130) arranged between the inner circular rim of the first open distal end and the outer circular rim of the second open distal end;

a coil (140) formed of a single wire (150), the coil comprising a plurality of coil sections (142, 146) arranged in a respective plurality of winding areas (144, 148), adjacent winding areas being separated by a circular rim of the one or more circular rims, coil sections in adjacent winding areas being wound about the tubular coil holder in opposite directions;

whereby a first end (152) and a second end (154) of the single wire are arranged in the circular groove; the inner circular rim comprising a longitudinal groove (114.1) to extend the first end and the second end of the single wire from the circular groove to a winding area adjacent to the circular groove; the one or more circular rims comprising a respective one or more longitudinal grooves (130.1) to extend the single wire from a winding area to the next winding area and vice versa;

an external connection (160) comprising a first conductor (162) and a second conductor (164); whereby an end of the first conductor is electrically connected to the first end of the single wire so as to form a first electrical connection (166) arranged in the circular groove and an end of the second conductor is electrically connected to the second end of the single wire so as to form a second electrical connection (168) in the circular groove and wherein the first and second conductor extend through the outer circular rim via a longitudinal groove (112.1) of the outer circular rim.

According to an aspect of the present invention, there is provided a coil assembly for a magnetic actuator, the coil assembly comprising:

a tubular coil holder (100) comprising a first (110) and second open distal end (120);

the first open distal end comprising an outer circular rim (112) and an inner circular rim (114) separated by a circular groove (116);

the second open distal end comprising an outer circular rim (122);

the tubular coil holder further comprising a central circular rim (130) arranged substantially halfway between the inner circular rim of the first open distal end and the outer circular rim of the second open distal end;

a coil (140) formed of a single wire (150), the coil comprising a first coil section (142) arranged in a first winding area (144) between the inner circular rim of the first open distal end and the central circular rim, and a second coil section (146) in a second winding area (148) between the central circular rim and the outer circular rim of the second distal end; the first coil section and the second coil section being wound about the tubular coil holder in opposite directions;

whereby a first end (152) and a second end (154) of the single wire are arranged in the circular groove; the inner circular rim comprising a longitudinal groove (114.1) to extend the first end and the second end of the single wire from the circular groove to the first winding area; the central circular rim comprising a longitudinal groove (130.1) to extend the single wire form the first winding area to the second winding area and vice versa;

an external connection (160) comprising a first conductor (162) and a second conductor (164); whereby an end of the first conductor is electrically connected to the first end of the single wire so as to form a first electrical connection (166) arranged in the circular groove and an end of the second conductor is electrically connected to the second end of the single wire so as to form a second electrical connection (168) in the circular groove and wherein the first and second conductor extend through the outer circular rim via a longitudinal groove (112.1) of the outer circular rim.

In a second aspect of the present invention, there is provided a method of manufacturing a coil assembly for a magnetic actuator, the method comprising the steps of:

providing a tubular coil holder (100) comprising a first (110) and second open distal end (120);

the first open distal end comprising an outer circular rim (112) and an inner circular rim (114) separated by a circular groove (116);

the second open distal end comprising an outer circular rim (122);

winding a coil (140) formed of a single wire (150) about the tubular coil holder, the coil being arranged in a winding area (144) between the inner circular rim of the first open distal end and the outer circular rim of the second distal end;

providing an external connection (160) comprising a first conductor (162) and a second conductor (164);

connecting an end of the first conductor electrically to the first end of the single wire so as to form a first electrical connection (166);

connecting an end of the second conductor electrically to the second end of the single wire so as to form a second electrical connection (168)

arranging the first end (152) and the second end (154) of the single wire, the first and second electrical connection and the ends of the first and second conductors in the circular groove;

extending the first and second conductor through the outer circular rim via a longitudinal groove (112.1) of the outer circular rim.

Instead of having one winding area, the coil assembly may also comprise two or more winding areas. As such, according to an aspect of the present invention, there is provided a method of manufacturing a coil assembly for a magnetic actuator, the method comprising the steps of:

providing a tubular coil holder (100) comprising a first (110) and second open distal end (120);

the first open distal end comprising an outer circular rim (112) and an inner circular rim (114) separated by a circular groove (116);

the second open distal end comprising an outer circular rim (122); the tubular coil holder further comprising a central circular rim (130) arranged substantially halfway between the inner circular rim of the first open distal end and the outer circular rim of the second open distal end;

winding a coil (140) formed of a single wire (150) about the tubular coil holder, the coil comprising a first coil section (142) arranged in a first winding area (144) between the inner circular rim of the first open distal end and the central circular rim, and a second coil section (146) in a second winding area (148) between the central circular rim and the outer circular rim of the second distal end; the first coil section and the second coil section being wound about the tubular coil holder in opposite directions; the single wire extending from the first winding area to the second winding area and vice versa via a longitudinal groove of the central circular rim;

providing an external connection (160) comprising a first conductor (162) and a second conductor (164);

connecting an end of the first conductor electrically to the first end of the single wire so as to form a first electrical connection (166);

connecting an end of the second conductor electrically to the second end of the single wire so as to form a second electrical connection (168)

arranging the first end (152) and the second end (154) of the single wire, the first and second electrical connection and the ends of the first and second conductors in the circular groove;

extending the first and second conductor through the outer circular rim via a longitudinal groove (112.1) of the outer circular rim.

According to an aspect of the present invention, there is provided a method of manufacturing a coil assembly for a magnetic actuator, the method comprising the steps of:

providing a tubular coil holder (100) comprising a first (110) and second open distal end (120);

the first open distal end comprising an outer circular rim (112) and an inner circular rim (114) separated by a circular groove (116);

the second open distal end comprising an outer circular rim (122);

the tubular coil holder further comprising one or more circular rims (130) arranged between the inner circular rim of the first open distal end and the outer circular rim of the second open distal end;

winding a coil (140) formed of a single wire (150) about the tubular coil holder, the coil comprising a plurality of coil sections (142) arranged in a respective plurality of winding areas (144) between the inner circular rim of the first open distal end and the outer circular rim of the second distal end; coil sections in adjacent winding areas being wound about the tubular coil holder in opposite directions; the one or more circular rims comprising a respective one or more longitudinal grooves (130.1) to extend the single wire from a winding area to the next winding area and vice versa;

providing an external connection (160) comprising a first conductor (162) and a second conductor (164);

connecting an end of the first conductor electrically to the first end of the single wire so as to form a first electrical connection (166);

connecting an end of the second conductor electrically to the second end of the single wire so as to form a second electrical connection (168)

arranging the first end (152) and the second end (154) of the single wire, the first and second electrical connection and the ends of the first and second conductors in the circular groove;

extending the first and second conductor through the outer circular rim via a longitudinal groove (112.1) of the outer circular rim.

These and other aspects of the invention will be more readily appreciated as the same becomes better understood by reference to the following detailed description and considered in connection with the accompanying drawings in which like reference symbols designate like parts.

DETAILED DESCRIPTION OF EMBODIMENTS

Figure 1A:
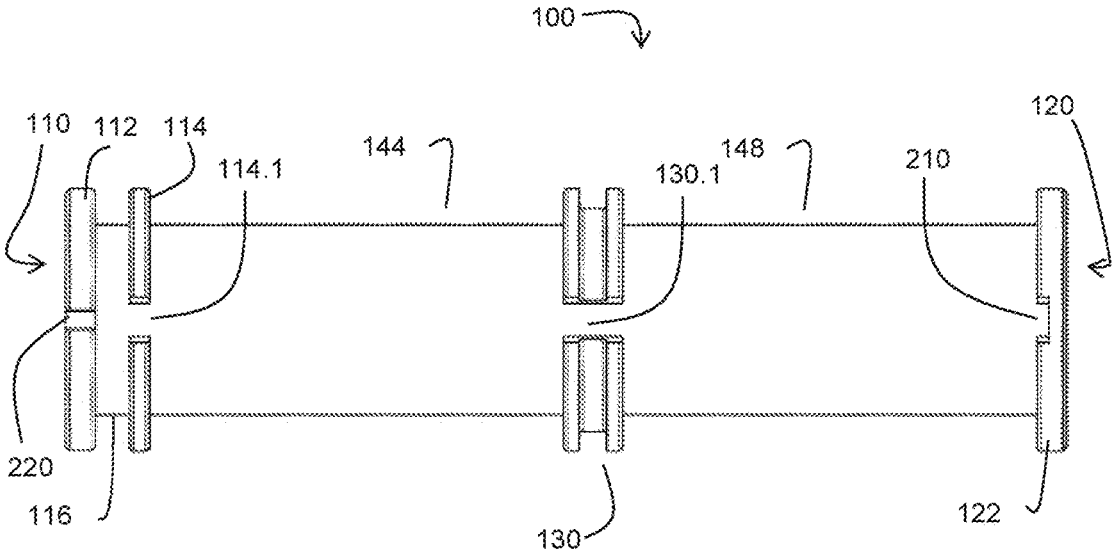
FIG. 1*a* depicts a side view of a tubular coil holder for a coil assembly for a magnetic actuator.
Figure 1B:
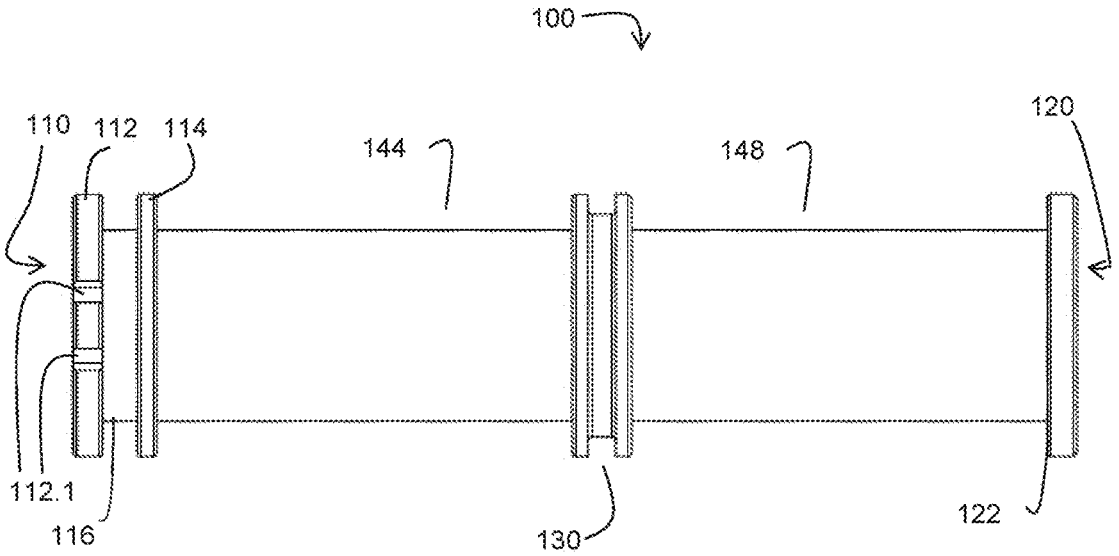
FIG. 1*b* shows the same tubular coil holder in a side view from the side opposite of the side shown in FIG. 1*a*.

FIG. 1*a* depicts a side view of a tubular coil holder 100 for a coil assembly for a magnetic actuator. Within the meaning of the present invention, a magnetic actuator refers to an actuator comprising a coil assembly, comprising a coil that can be supplied with an electric current, and a magnet assembly, the coil assembly and magnet assembly being configured to co-operate so as to generate a force. As will be appreciated by the skilled person, such a combination of a coil assembly and a magnet assembly may equally be applied as a sensor. In particular, when a magnet assembly is displaced relative to the coil assembly, this displacement may be sensed, based on the induced voltage in the coil. As such, the coil assembly according to the present invention may equally be used in a magnetic sensor. FIG. 1*b* shows the same tubular coil holder 100 in a side view from the side opposite of the side shown in FIG. 1*a*. The tubular coil holder 100 may for example be made from the following materials:

injection molded plastics, e.g. Nylon, PTFE (Polytetrafluoroethylene), Polyamide Composite, Thermoplastic, composite materials such as carbon, metallic materials such as steel, Bronze, Tin-bronze, Aluminium-bronze, etc.

In an embodiment, the coil holder can be made from anodized Aluminium. Such a coil holder may further be coated with a PTFE coating or the like.

The tubular coil holder may e.g. be manufactured by means of casting, injection moulding, milling, turning, grinding or deep-drawing.

In the embodiment as shown, the tubular coil holder 100 comprises a first open distal end 110 and a second open distal end 120. The first open distal end 110 comprises an outer circular rim 112 and an inner circular rim 114. A circular groove 116 is located between the outer circular rim 112 and the inner circular rim 114. The second open distal end 120 on the other hand, comprises only an outer circular rim 122. In an embodiment, the opening at the first distal end and the opening at the second distal end are circular openings with a diameter equal to the inner diameter of the coil holder. As such, a cylindrical shaped magnetic member may be inserted into the tubular coil holder from either side.

In the embodiment as shown, the tubular coil holder 100 further comprises a central circular rim 130, which defines a first winding area 144 and a second winding area 148 of the coil holder 100. The first winding area 144 is located between the inner circular rim 114 of the first open distal end 110 and the central circular rim 130. The second winding area 148 is located between the central circular rim 130 and the outer circular rim 122 of the second distal end 120. The central circular rim 130 is preferably, as in the shown embodiment, arranged substantially halfway between the inner circular rim 114 of the first open distal end 110 and the outer circular rim 122 of the second open distal end 120, such that the first winding area 144 and the second winding area 148 are substantially the same size.

The application of the central circular rim subdivides the coil winding area into two winding areas 144 and 148. It should be noted that coil holders as applied in the present invention may also be equipped with a single winding area or with more than two winding areas. In case only a single winding area is applied, the central circular rim 130 can be omitted. In case more than two winding areas are applied, each pair of adjacent winding areas may be separated by a circular rim. The circular rims may then be arranged such that the different winding areas substantially have the same size.

As is visible in FIG. 1*a*, the inner circular rim 114 of the first distal end 110 comprises a longitudinal groove 114.1 which forms a passage from the circular groove 116 to the first winding area 144 and/or vice versa. It is noted that in the context of the present invention longitudinal is to be understood as generally in the longitudinal direction of the tubular coil holder. Similarly, the central circular rim 130 comprises a longitudinal groove 130.1 which forms a passage from the first winding are 144 to the second winding area 148 and/or vice versa.

As visible in FIG. 1*b*, the outer circular rim 112 also comprises a longitudinal groove 112.1, which forms a passage from the circular groove 116 to outside the tubular coil holder 100. In the shown example, the longitudinal groove 112.1 comprises of two grooves; however, it is envisaged that the longitudinal groove 112.1 may also be formed by a single groove. Additionally, the longitudinal groove 112.1 may comprise more than two grooves along the circumference, such that the location on the outer circular rim 112 where a passage is required can be selected based on the application. As an alternative, one or more holes may be provided in the outer circular rim 112. Whether or not grooves or holes are applied may e.g. depend on the material used for the coil holder. When the coil holder is made by injection molding, a notch or notches may be preferred, whereas, when the coil holder is made from a metal or metallic material, one or more holes may be preferred. As will be discussed later, this passage or groove or hole may be used to house an electrical connector that is connected to the coil wound about the coil holder 100.

Furthermore in the shown example, the longitudinal groove 112.1 is located on the opposite side of the tubular coil holder 100 with respect to longitudinal grooves 114.1 and 130.1. This is advantageous for the mechanical integrity of the coil, as will be explained further below, but not a requirement for the present invention.

Figure 2A:
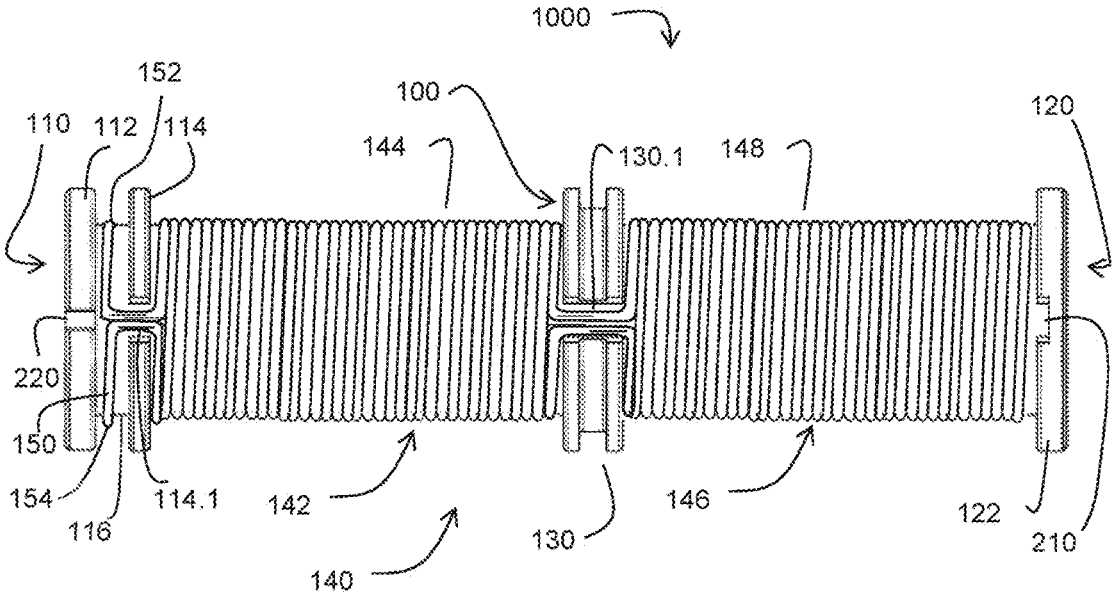
FIG. 2*a* depicts a coil assembly comprising the tubular coil holder of FIGS. 1*a*-1*b* with a coil arranged thereon.

FIG. 2*a* depicts a coil assembly 1000 comprising the tubular coil holder 100 of FIGS. 1*a*-1*b* with a coil 140 arranged thereon. The coil 140 is formed by a single wire 150, and comprises a first coil section 142 that is arranged on the first winding area 144 of the tubular coil holder 100, and a second coil section 146 that is arranged on the second winding area 148 of the tubular coil holder 100. The first coil section 142 and the second coil section 146 are wound about the tubular coil holder 100 in opposite direction. That is, one on the first coil section 142 and the second coil section 146 is wound in clockwise direction while the other is wound in counter-clockwise direction. The single wire 150 of the coil 140 begins at a first end 152 and ends at a second end 154, which are both arranged in the circular groove 116 when the single wire 150 has been wound.

The winding of the single wire 150 on the tubular coil holder 100 to form the coil 140 can be accomplished in several ways. For example, the first end 152 can be arranged in the circular groove 116. A bend of substantially 90 degrees is applied in the wire 150 such that the wire 150 extends into the longitudinal groove 114.1. Once extended through the longitudinal groove 114.1, the wire 150 is bended for substantially 90 degrees again. Preferably, the wire 150 is bended in such a way that it forms a U-shape around a part of the inner circular rim 114 of the first distal end 110. This improves the mechanical stability of the coil and reduces the influence of pulling forces in the first end 152 of the wire onto the first coil section 142. The wire 150 is then wound around the first winding area 144 of the tubular coil holder 100, from the inner circular rim 114 of the first distal end 110 until the central circular rim 130. Once the central circular rim 140 has been reached, the wire 150 is again bend by substantially 90 degrees to extend through the longitudinal groove 130.1 into the second winding area 148, followed by another bend of substantially 90 degrees, again preferably forming a U-shape. The wire 150 is wound around the tubular coil holder 100 in the second winding area 148 from the central circular rim 130 until the outer circular rim 122 and back, forming two layers of windings. The wire 150 is then again wound around the tubular coil holder 100 in the second winding area 148 from the central circular rim 130 until the outer circular rim 122 and back until the desired number layers of windings for forming the second coil section 146 has been reached. Thereafter, the wire 150 is bended twice by approximately 90 degrees again to extend through the longitudinal groove 130.1 back into the first winding area 144, and subsequently wound around the tubular coil holder 100 until the inner circular rim 114 of the first distal end 110 has been reached. The wire 150 is then wound around the tubular coil holder 100 in the first winding area 144 from the inner circular rim 114 of the first distal end 110 until the central circular rim 130 and back until the desired number of layers of windings for forming the first coil section 142 has been reached. Preferably, the first coil section 142 has the same number of layers as the second coil section 146. Finally, the wire 150 is again bended twice by substantially 90 degrees, such that the second end 154 of the wire 150 is arranged in the circular groove 116. Preferably, the second end 154 is wound in opposite direction of the first end 152.

Another possible method for winding the wire 150 can for example be to first wind the wire 150 in the first winding area 144 until one layer less than the desired number of layers for the first coil section 142 has been reached, followed by winding the complete second coil section 146 and then arranging the last layer of the first coil section 142. Of course, it is also possible to cross the longitudinal groove 130.1 more than twice, e.g. by always winding a layer in both the first 142 and second coil section 146 before winding the next layer, provided that the longitudinal groove 130.1 is designed to provide sufficient space for this.

By winding the first coil section 142 in an opposite direction as compared to the second coil section 146, a coil having two sections is formed by a single wire 150.

As indicated above, the tubular coil holder as applied in the coil assembly according to the present invention may also comprise more than two coil winding areas and coil sections. The coil holder may e.g. be arranged to have 3 or 4 or more coil winding areas and coil sections, which may be separated by circular rims as discussed above. Such coil arrangements may also be wound with a single wire coil, whereby longitudinal grooves in the circular rims separating the winding areas may be applied to extend the single wire from one winding area to another and vice versa. In such an arrangement, the coil sections applied in adjacent coil winding areas may be wound in opposite directions about the coil holder.

Figure 2B:
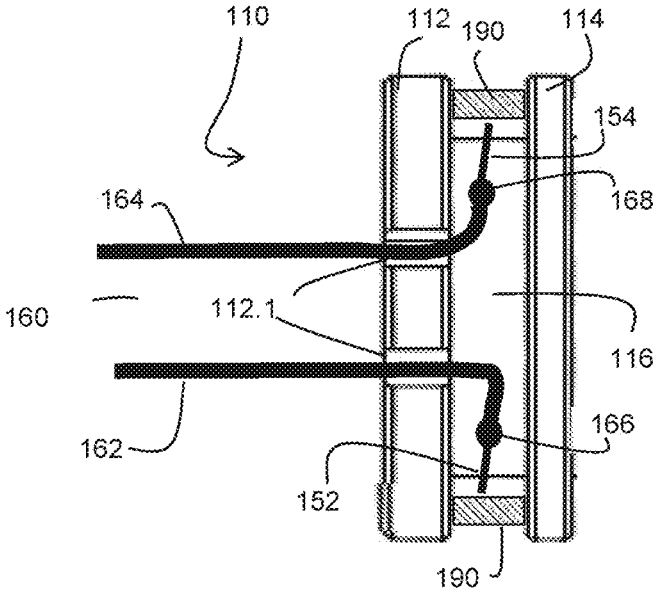
FIG. 2*b* shows an enlarged view of the first distal end from the opposite side of FIG. 2*a*.

In the shown example, the first end 152 and the second end 154 are arranged in the circular groove 116 to extend towards the other side of the tubular coil holder 100. FIG. 2*b* shows an enlarged view of the first distal end 110 from the opposite side of FIG. 2*a*. It is further noted that in FIG. 2*b* the tubular coil holder is rotated by a half turn, meaning that the first end 152 of the wire is now below while the second end 154 is above. An external connection 160 is provided comprising a first conductor 162 and a second conductor 164. In the shown example, the first and second conductor 162, 164 are embodied as electric wires provided with an insulation layer; however, it is also possible to use metal pins, e.g. electrically conducting pins, e.g. L.-shapes pins. The external connection may also be provided by a multi-wire cable. The first and second conductor 162, 164 extend through the outer circular rim 112 via the longitudinal groove 112.1. A first electrical connection 166 is formed between the first conductor 162 and the first end 152 of the wire. Similarly, a second electrical connection 168 is formed between the second conductor 164 and the second end 154 of the wire. Both the first 166 and second electrical connection 168 are located in the circular groove 116. The first and second electrical connection 166, 169 can for example be soldered.

By providing the electrical connections 166, 168 in the circular groove 116 and thus inside the coil assembly rather than outside, they are protected from damage by external components, thereby increasing the integrity and endurance of the coil assembly. Furthermore, the first end 152 and second end 154 of the wire are not loose outside the coil assembly. An additional advantage is that forces on the external connection 160, e.g. pulling forces in the wires, have less influence on the wire of the coil. This effect is enhanced by arranging the longitudinal groove 112.1 in the outer circular rim 112 on the other side of the tubular coil holder 100 as compared to the longitudinal groove 114.1 in the inner circular rim 114 shown in FIG. 2*a*. In an embodiment, the size of the longitudinal groove 112.1 is selected in such manner that the electrical conductors 162 and 164 are somewhat clamped inside the groove, i.e. due to friction between the insulation of the electrical conductors 162, 164 and the groove 112.1, the electrical conductors are prohibited from displacing in the longitudinal direction, relative to the coil holder. As such, a mechanical stress on the connections 166 and 168 can be, to a large extend, be avoided.

FIG. 2*b* further shows a heat shrink fitting 190, also know as a heat shrink tube or tubing, which can optionally be applied in the circular groove 116. The heat shrink fitting 190 is arranged over at least the first and second electrical connection 166, 168, and is preferably circular surrounding the entire circular groove 116. In FIG. 2*b* the heat shrink fitting 190 is shown in a cross-sectional view for the sake of clarity. Once the heat shrink fitting 190 is arranged in the circular groove 116, it is shrunk, usually be applying heat on it, e.g. with hot air. Possible materials to realize such heat shrink fitting are PTFE, FEP, PTFE/FEP, Kynar and Viton. The shrinking of the heat shrink fitting 190 accomplishes that at least the first and second electrical connection 166, 168 are clamped in the circular groove 116, optionally together with the first and second end 152, 154 of the wire. Furthermore, the heat shrink fitting 190 can provide an electrical insulation.

Figure 3:
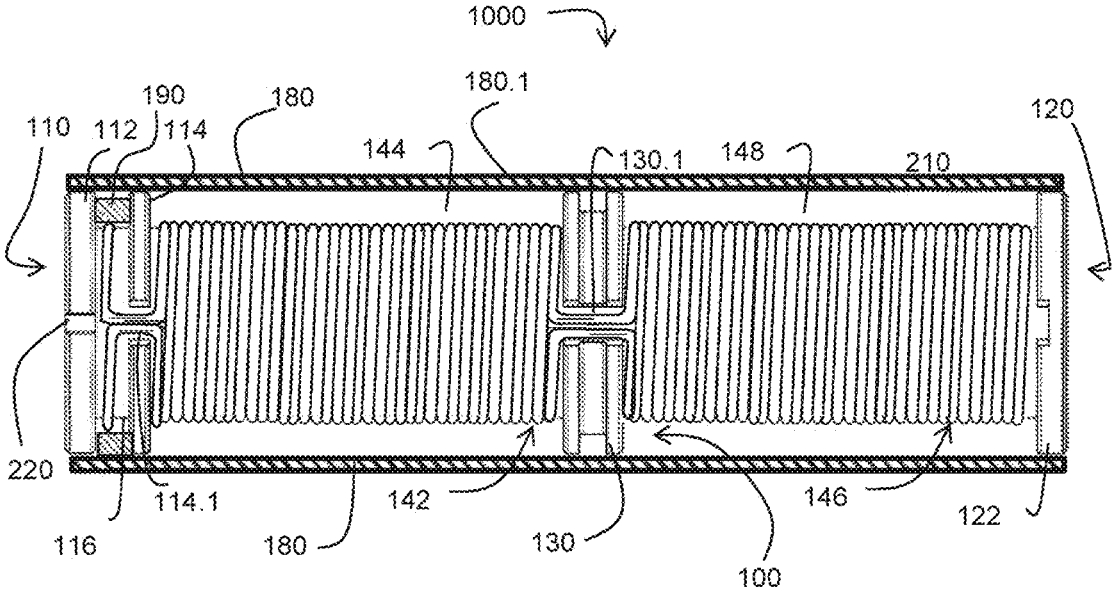
FIG. 3 shows a coil assembly with an optional tubular housing arranged on the tubular coil holder.

FIG. 3 shows the coil assembly 1000 with an optional tubular housing 180 arranged on the tubular coil holder 100. In FIG. 3 the housing 180 is shown in a cross-sectional view for the sake of clarity. The housing 180 may for example be made from a ferritic material, steel or stainless steel. The inner diameter of the tubular housing 180 is substantially equal to a diameter of the outer circular rim 112 of the first distal end 110 and a diameter of the outer circular rim 122 of the second distal end 120. The housing 180 keeps the wire 150 of the coil and the connection wires 162 and 164 in place. In addition, the housing 180 may serve to guide a magnetic flux as generated by the coil assembly, e.g. when co-operating with a magnet assembly so as to form a magnetic sensor or magnetic actuator. This will be explained in more detail below. In accordance with the present invention, by ensuring that the electrical conductors 164 and 162 can be brought outside the coil holder via a notch or notches 112.1 of the outer rim 112, the maximum size of the coil assembly perpendicular to the longitudinal axis corresponds to the outer diameter of the housing 180. This results in a slim design of the coil assembly having a substantial cylindrical outer surface 180.1 without any wires or connectors protruding said surface. As can be seen in FIG. 3, there is some open space between the first coil section 142 and the housing 180, as well as between the second coil section 146 and the housing 180. Even if more layers of windings are provided in the first and second coil section 142, 146, this will usually still be the case. Optionally, this open space can be filled with an impregnating or potting/casting compound, which is explained in more detail with reference to FIGS. 4*a*-4*c*. suitable compound for such an impregnating or potting/casting process are Epoxy, Polyurethane, Polybutadiene and Silicone.

Figure 4A:
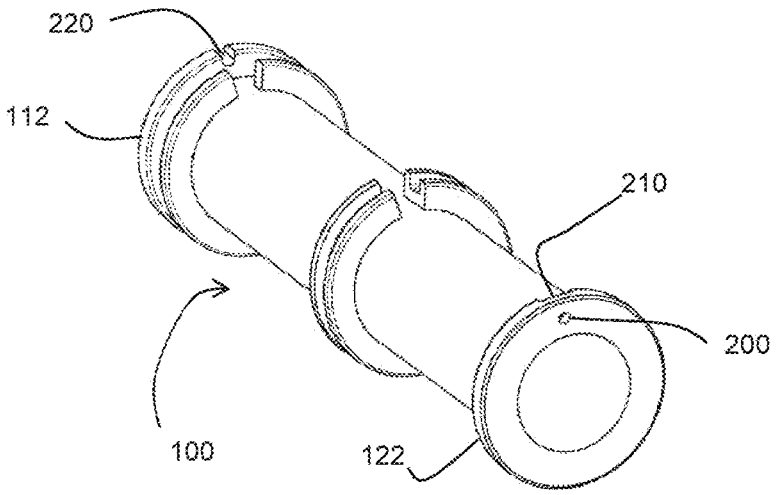
FIG. 4*a* shows an isometric view of the tubular coil holder.
Figure 4B:
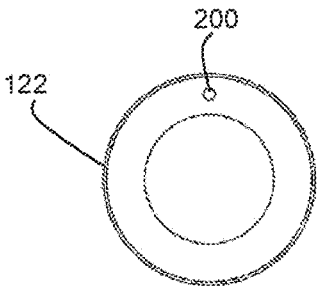
FIG. 4*b* shows a front view showing the outer circular rim of the second open distal end.
Figure 4C:
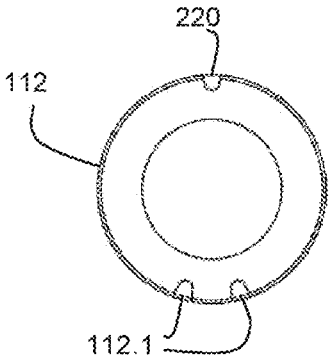
FIG. 4*c* shows a back view showing the outer circular rim 112 of the first open distal end.

FIG. 4*a* shows an isometric view of the tubular coil holder 100, while FIG. 4*b* shows a front view showing the outer circular rim 122 of the second open distal end and FIG. 4*c* shows a back view showing the outer circular rim 112 of the first open distal end. The coil and the tubular housing are omitted in FIGS. 4*a*-4*c* for the sake of clarity. As can be seen in FIG. 4*a* and FIG. 4*b*, the outer circular rim 122 of the second distal end comprises a through hole 200. Alternatively, a notch may be applied as well. Whether or not to apply a through hole or a notch may depend on the material used to make the coil holder. Once coil and the housing are arranged, an impregnating or potting/casting compound may be injected through the through hole 200. The impregnating or potting/casting compound will fill the space between the tubular coil holder 100 and the housing. The impregnating or potting/casting compound essentially clamps the coil and ensures that the wire of the coil remains stable in its position. The impregnating or potting/casting compound may also provide in an improved electrical insulation. The compound also provides an improved heat path from the coil to the housing.

Advantageously, the outer circular rim 122 may comprise a recess 210 wherein the through hole 200 is located. The recess 210 facilitates the injection of the impregnating or potting/casting compound, as it ensures that there is some open space which is not occupied by the coil, such that it is avoided that the coil blocks the compound from entering the space between the tubular coil holder 100 and the housing.

The outer circular rim 112 of the distal end may comprise a notch 220, as is visible in FIG. 4*a* and FIG. 4*c*. The notch 220 provides an escape passage for the air in the space filled by the impregnating or potting/casting compound during said filling. Additionally, it can visually be detected when said space is filled when the impregnating or potting/casting compound reached the notch 220. It is further noted that in the shown example, the notch 220, as well as the longitudinal groove 112.1 which is visible in FIG. 4*c*, is closed by the housing when the housing is arranged in place. It is noted that in general, a notch 220 and longitudinal groove 112.1 has the advantage over a hole that it is easier to provide during injection molding.

The coil assembly 1000 described with reference to FIGS. 1*a*-4*c* may for example be part of an electromagnetic actuator. For this, the tubular coil 100 holder may be configured to receive a cylindrical magnet assembly. As explained above, the first distal end 110 and the second distal end 120 are both open, i.e. both outer circular rims 112, 122 have an opening for receiving said cylindrical magnet assembly. Optionally, at least a part of an inner surface of the tubular coil holder 100 is configured to be a sliding bearing surface.

Figure 5:
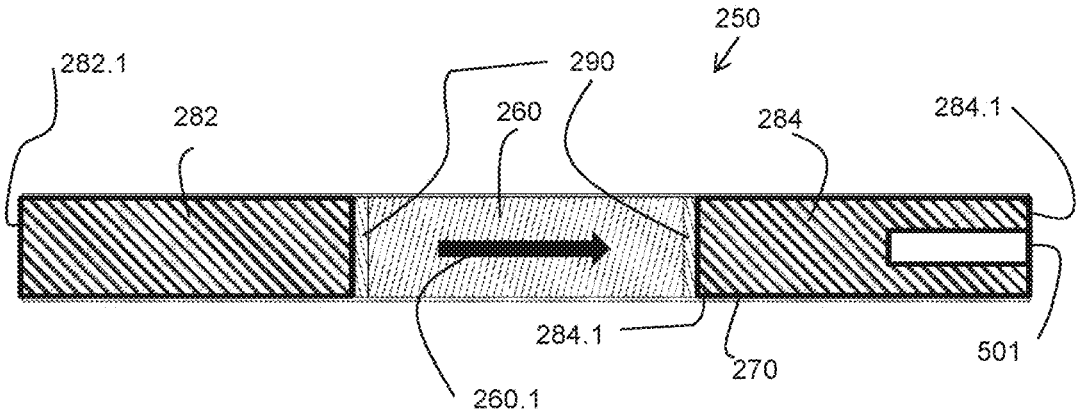
FIG. 5 depicts a cylindrical magnet assembly which can be inserted in the tubular coil holder.

FIG. 5 depicts an example of a cylindrical magnet assembly 250 which can be inserted in the tubular coil holder. The cylindrical magnet assembly 250 is dimensioned such that a diameter of an outer surface of the cylindrical magnet assembly 250 substantially corresponds to a diameter of an inner surface of the tubular coil holder. Thereby, the cylindrical magnet assembly 250 is configured to be inserted into the tubular coil holder. Furthermore, the inner surface of the tubular coil holder and the outer surface of the cylindrical magnet assembly 250 form a sliding bearing to enable longitudinal movement of the cylindrical magnet assembly 250 relative to the tubular coil holder.

The cylindrical magnet assembly 250 comprises a permanent magnet 260, which is, in the embodiment as shown, magnetized in a longitudinal direction of the cylindrical magnet assembly 250, as indicated by the arrow 260.1. When an electrical current is provided in the wire of the coil, the permanent magnet 260 is subjected to a force which is dependent on the magnetic flux density and the current. By reversing the direction of the current, the force is reversed to the other direction. As such, the movement of the cylindrical magnet assembly 250 can be controlled with the coil assembly, thereby providing a magnetic actuator. Since both the tubular coil holder and the housing of the coil assembly are open, the cylindrical magnet assembly 250 can move in both longitudinal directions. It is also free to rotate around its axis.

It may be pointed out that the magnet assembly may comprise multiple permanent magnets such an array of alternatingly polarized permanent magnets, alternatingly polarized in the longitudinal direction. Alternatively, use may also be made of radially magnetized permanent magnets such as ring shaped permanent magnets. The magnet assembly of the electromagnetic actuator according to the present invention may e.g. comprise one or more of such ring shaped, radially magnetized permanent magnets.

In the embodiment as shown, the cylindrical magnet assembly comprises a housing 270 into which the permanent magnet 260 is mounted. The permanent magnet 260 is fixed inside the housing 270 by means of a pair of end-rods 282, 284. The end-rods 282, 284 may for example be made from aluminum or an other non magnetic material or plastic. The end-rods may e.g. be glued into the housing 270.

End-rod 284 comprises a threaded hole 501. As such, other components can be attached to the electromagnetic actuator, said other components being the parts desired to be controlled and moved by the electromagnetic actuator. Of course, any other suitable attachment means could be applied as well.

In an embodiment, end-rod 282 may also be provided with a hole, e.g. a threaded hole, extending in the longitudinal direction.

In yet another embodiment, the magnet assembly 250 may be a tubular magnet assembly. In such embodiment, the magnet assembly 250 may comprise a through hole, extending through the magnet assembly 250 along the longitudinal direction, e.g. between end surface 282.1 of end-rod 282 to end surface 284.1 of end-rod 284. In such embodiment, the permanent magnet 260 can thus be a tubular shaped permanent magnet. Such embodiment can provide feed through possibilities, through the through hole of the magnet assembly. In order to attach any load to the actuator, the end-rod or end-rods can be provided with multiple holes as well or with any other mechanical means.

In the embodiment as shown, the permanent magnet 260 is arranged in between two pole-shoes 290, which can e.g. be made from a ferromagnetic material, to enhance the magnetic field generated by the permanent magnet 260.

Figure 6:
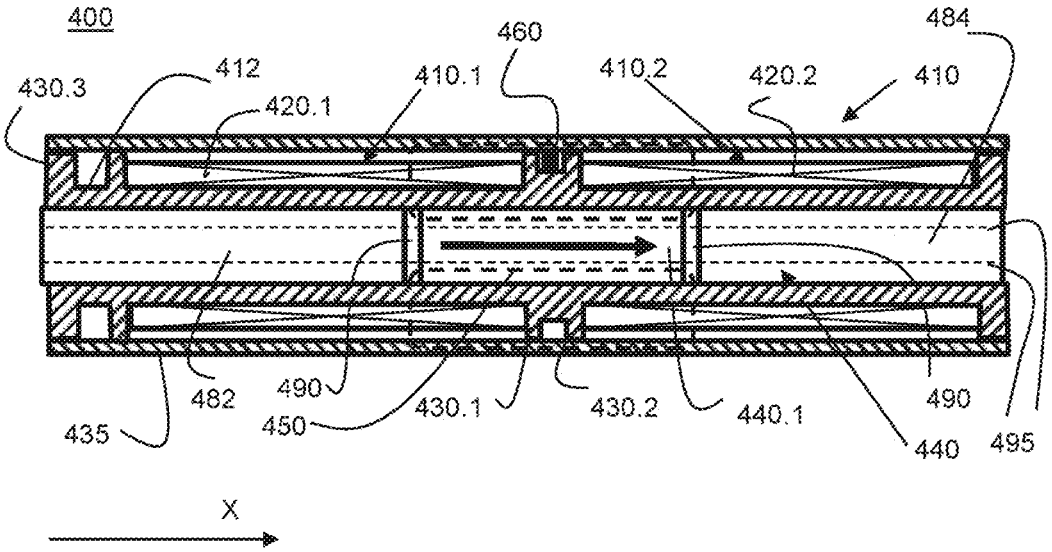
FIG. 6 depicts a cross-sectional view of an actuator according to the present invention.

FIG. 6 schematically shows a cross-sectional view of a magnetic actuator 400 according to the present invention. The actuator 400 as shown comprises a coil assembly 410 according to the present invention, the coil assembly comprising a tubular coil holder 412 having two coil winding areas 410.1, 410.2 onto which coils 420.1 and 420.2 are wound. As explained above, the coils may be wound from a continuous wire crossing the central rims 430.1 and 430.2, comparable to rim 130, in a manner as described above. In the embodiment as shown, the coil assembly is mounted in a magnetically conductive housing 435. The actuator 400 further comprises a magnet assembly 440 that is arranged inside the tubular coil holder, whereby an inner diameter of the tubular coil holder is dimensioned to be equal or slightly larger than an outer diameter of the magnet assembly 440. In the embodiment as shown, the magnet assembly comprises a cylindrical shaped permanent magnet 440.1 magnetized along the axial direction X. In the embodiment as shown, the permanent magnet 440.1 is arranged in between two pole-shoes 490, which can e.g. be made from a ferromagnetic material, to enhance the magnetic field generated by the permanent magnet 440.1. In the embodiment as shown, lines 450 schematically represent magnetic flux lines generated by the magnet assembly 440. As can be seen, the magnetic flux lines 450 cross the coils 420.1 and 420.2 and close via the magnetically conductive housing 435 that is mounted to the coil assembly 410. In the embodiment as shown, the magnet assembly 440 further comprises two end rods 482, 484 comparable to the end rods 282, 284 as described above. The end rods 482, 484, the permanent magnet 440.1 and the pole shoes 490 may all have substantially the same diameter and may be arranged inside a tubular housing (not shown), in a similar manner as the magnet arrangement 250 is arranged inside housing 270. In an embodiment, either one or both end rods 482 484 may comprise a hole such as a threaded hole to facilitate connecting the magnet assembly 440 to a load. Alternatively, the magnet assembly 440 may comprise a through hole through the magnet assembly along the longitudinal direction, i.e. the X-direction. The dotted lines 495 indicate where such a through hole may be located.

Compared to a typical or conventional voice-coil actuator, the mounting of the housing 435 to the coil assembly 410 as done in the actuator according to the present invention, enables the magnet assembly 440 to become smaller and lighter. In a typical voice coil actuator, a back-iron for guiding the magnetic flux as generated by the permanent magnet or magnets would be arranged as part of the magnet assembly, rendering the magnet assembly more bulky and heavier.

In an embodiment of the present invention, the actuator 400 according to the present invention may further comprises a magnetic sensor 460. In the embodiment as shown in FIG. 6, the magnetic sensor 460 is arranged in an aperture provided between central rims 430.1 and 430.2. Such a magnetic sensor may e.g. be a Hall-sensor or (Giant) Magnetoresistance sensor. The wires of such a magnetic sensor 460 may advantageously be arranged to exit the tubular coil holder 412 in a similar manner as the electrical connectors, i.e. via one or two notches provided in the outer rim 430.3 of the tubular coil holder 412. The magnetic sensor 460 may e.g. be mounted in a central position along the longitudinal axis of the coil assembly 410. The magnetic sensor 460 may thus be configured to generate a signal representative of a position of the magnet assembly 440 relative to the coil assembly 410 along the longitudinal axis. Based on said signal, a current as supplied to the coils 420.1 and 420.2 may be controlled. In an embodiment, the signal could be post processed to take account of any non-linearity of the signal or to take account of the influence of the current in the coil or coils. Such post processing can e.g. be based on empirical data or simulation data describing the dependency of the signal on the magnet position and/or the coil currents. By means of such post processing, the non-linearity of the signal can be taken into account and the contribution of the coil currents to the magnetic field distribution can be substantially eliminated, thereby eliminating their influence on the position signal.

Figure 7:
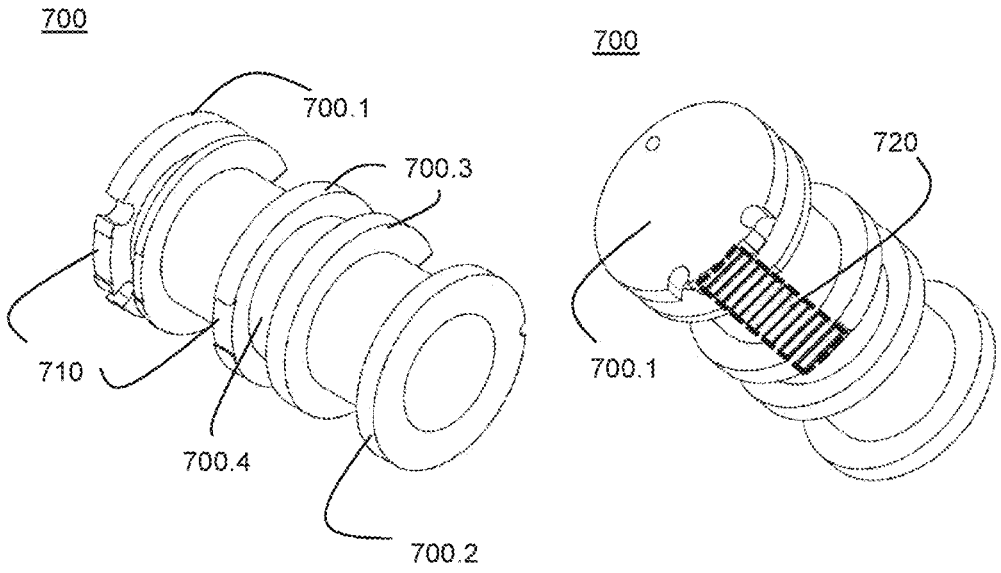
FIG. 7 depicts a plan view of a tubular coil holder as can be applied in the present invention.

In an embodiment, the coil assembly of the magnetic actuator or sensor according to the present invention may comprise a magnetic sensor that is mounted to a flexible PCB (printed circuit board). Such a flexible PCB, or flex PCB, may e.g. be mounted along an outer circumference of a coil holder as can be applied in the present invention. FIG. 7 schematically shows a plan view of a tubular coil holder 700 onto which a flexible PCB, e.g. including a magnetic sensor, may be mounted.

On the left side of FIG. 7, a tubular coil holder 700 is shown including, in a similar manner as described above, outer rims 700.1 and 700.2 and a pair of central rims 700.3 separated by a circular groove 700.4. In the embodiment as shown, a strip-shaped recess 710 is provided in the outer rim 700.1 and in one of the central rims 700.3. Such recesses can be used to accommodate the flex PCB. In the Figure on the right, the tubular coil holder 700 is shown including the flexible PCB 720, the flexible PCB 720 being arranged in the strip-shaped recesses 710. By appropriate sizing of the strip-shaped recesses, one can ensure that the flexible PCB remains inside the outer diameter of the outer rims 700.1 and 700.2.

Figure 8:
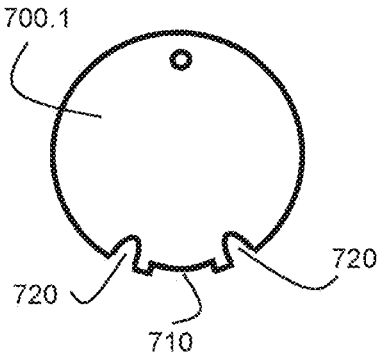
FIG. 8 depicts a cross-sectional view of an outer rim of a coil holder as can be applied in the present invention.

FIG. 8 schematically shows a cross-sectional view of the outer rim 700.1, including two notches 720 for outputting electrical conductors and the strip-shaped recess 710 for accommodating a flexible PCB.

In an embodiment, the actuator according to the present invention may further comprise a temperature sensor. Such a temperature sensor may e.g. be an NTC resistor (negative temperature coefficient). In an embodiment, such a temperature sensor can also be mounted to a flex PCB. In an embodiment, the temperature sensor may be mounted to a flex PCB together with a magnetic sensor. The signals of the sensors may e.g. be brought to the outside of the actuator via the flex PCB.

The actuator according to the present invention may advantageously be applied in applications where comparatively small displacements are required such as displacing rods or guides in conveyor systems or opening/closing valves. Compared to hydraulic or pneumatic actuator systems, the force as generated by the electromagnetic actuator according to the present invention may be more accurately controlled.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps). Any reference signs in the claims should not be construed as limiting the scope of the claims or the invention.

The mere fact that certain measures are recited in mutually different dependent claims does not indicate that a combination of these measures cannot be used to advantage.

The term coupled, as used herein, is defined as connected, although not necessarily directly, and not necessarily mechanically.

The invention claimed is:

1. A coil assembly for a magnetic actuator, the coil assembly comprising:

a tubular coil holder comprising a first and second open distal end, the first open distal end comprising an outer circular rim and an inner circular rim separated by a circular groove, and the second open distal end comprising an outer circular rim;

a coil formed of a single wire, the coil being arranged in a winding area between the inner circular rim of the first open distal end and the outer circular rim of the second distal end, wherein a first end and a second end of the single wire are arranged in the circular groove, and the inner circular rim comprises a longitudinal groove to extend the first end and the second end of the single wire from the circular groove to the winding area;

a tubular housing, the tubular housing having an inner diameter substantially equal to a diameter of the outer circular rim of the first distal end and a diameter of the outer circular rim of the second distal end;

an external connection comprising a first conductor and a second conductor, wherein an end of the first conductor is electrically connected to the first end of the single wire so as to form a first electrical connection arranged in the circular groove and an end of the second conductor is electrically connected to the second end of the single wire so as to form a second electrical connection in the circular groove, wherein the first and second conductor extend in a longitudinal direction through the outer circular rim via a longitudinal groove of the outer circular rim, wherein the longitudinal groove of the outer circular rim forms a passage from the circular groove to outside of the tubular coil holder, and wherein the longitudinal groove of the outer circular rim and the longitudinal groove of the inner circular rim are disposed on opposite sides of the tubular coil holder such that the longitudinal groove of the outer circular rim is diametrically opposed to the longitudinal groove of the inner circular rim.

2. The coil assembly according claim 1, further comprising a heat shrink fitting surrounding the circular groove, the heat shrink fitting being configured to clamp the first and second electrical connections in the circular groove and to provide an electrical isolation.

3. The coil assembly according to claim 1, wherein the tubular housing comprises a ferromagnetic material.

4. The coil assembly according to claim 3, wherein the outer circular rim of the second distal end comprises a through hole for injecting an impregnating or potting or casting compound into a space between the tubular coil holder and the housing.

5. The coil assembly according to claim 4, wherein the through hole is provided in a recess of the outer circular rim, the recess being configured to facilitating the injection of the impregnating or potting or casting compound into the space.

6. The coil assembly according to claim 4, wherein the outer circular rim of the first distal end comprises a notch for monitoring the injection process and for allowing air to escape from the space during the injection process.

7. The coil assembly according to claim 3, wherein the tubular housing is made from stainless steel, ferromagnetic steel, amorphous or sintered material, or tape wound.

8. The coil assembly according to claim 1, wherein an inner surface of the tubular coil holder is configured as a sliding bearing surface.

9. The coil assembly according to claim 1, wherein the tubular coil holder is configured to receive a cylindrical magnet assembly, a diameter of an outer surface of the cylindrical magnet assembly substantially corresponding to a diameter of an inner surface of the tubular coil holder, the inner surface of the tubular coil holder and the outer surface of the cylindrical magnet assembly forming a sliding bearing.

10. The coil assembly according to claim 1, wherein the tubular coil former is made from injection molded plastic such as Nylon, PTFE, Polyamide, Composite, Thermoplastic, or made from a composite material such as carbon, or made from a metallic material such as steel, Bronze, Tin-bronze, or Aluminium-bronze.

11. The coil assembly according to claim 1, further comprising a magnetic sensor mounted to the tubular coil former.

12. The coil assembly according to claim 11, wherein the magnetic sensor is arranged in a circular groove of a central circular rim.

13. The coil assembly according to claim 11, wherein the magnetic sensor comprises a Hall-sensor, a Magnetoresistance sensor or a Giant Magnetoresistance sensor.

14. The coil assembly according to claim 11, wherein the magnetic sensor is mounted to a flexible PCB.

15. The coil assembly according to claim 1, further comprising a temperature sensor.

16. An electromagnetic actuator comprising a coil assembly according to claim 1.

17. The electromagnetic actuator according to claim 16, further comprising a cylindrical magnet assembly, the cylindrical magnet assembly being configured to be inserted into the tubular coil holder.

18. The electromagnetic actuator according to claim 17, wherein the cylindrical magnet assembly comprises a permanent magnet magnetized in a longitudinal or radial of the cylindrical magnet assembly.

19. The electromagnetic actuator according to claim 17, wherein the cylindrical magnet assembly comprises a housing into which the permanent magnet is mounted.

20. The electromagnetic actuator according to claim 17, wherein the permanent magnet is fixed inside the housing by means of a pair of end-rods.

21. A coil assembly for a magnetic actuator, the coil assembly comprising:

a tubular coil holder comprising a first and second open distal end;

the first open distal end comprising an outer circular rim and an inner circular rim separated by a circular groove;

the second open distal end comprising an outer circular rim, the tubular coil holder further comprising one or more circular rims arranged between the inner circular rim of the first open distal end and the outer circular rim of the second open distal end;

a coil formed of a single wire, the coil comprising a plurality of coil sections arranged in a respective plurality of winding areas, adjacent winding areas being separated by a circular rim of the one or more circular rims, coil sections in adjacent winding areas being wound about the tubular coil holder in opposite directions;

wherein a first end and a second end of the single wire are arranged in the circular groove, the inner circular rim comprising a longitudinal groove to extend the first end and the second end of the single wire from the circular groove to a winding area adjacent to the circular groove, and wherein the one or more circular rims comprises a respective one or more longitudinal grooves to extend the single wire from a winding area to the next winding area and vice versa;

a tubular housing, the tubular housing having an inner diameter substantially equal to a diameter of the outer circular rim of the first distal end and a diameter of the outer circular rim of the second distal end;

an external connection comprising a first conductor and a second conductor, wherein an end of the first conductor is electrically connected to the first end of the single wire so as to form a first electrical connection arranged in the circular groove and an end of the second conductor is electrically connected to the second end of the single wire so as to form a second electrical connection in the circular groove, wherein the first and second conductor extend in a longitudinal direction through the outer circular rim via a longitudinal groove of the outer circular rim, and wherein the longitudinal groove of the outer circular rim and the longitudinal groove of the inner circular rim are disposed on opposite sides of the tubular coil holder such that the longitudinal groove of the outer circular rim is diametrically opposed to the longitudinal groove of the inner circular rim.

22. A coil assembly for a magnetic actuator, the coil assembly comprising:

a tubular coil holder comprising a first and second open distal end, the first open distal end comprising an outer circular rim and an inner circular rim separated by a circular groove, the second open distal end comprising an outer circular rim, the tubular coil holder further comprising a central circular rim arranged substantially halfway between the inner circular rim of the first open distal end and the outer circular rim of the second open distal end;

a coil formed of a single wire, the coil comprising a first coil section arranged in a first winding area between the inner circular rim of the first open distal end and the central circular rim, and a second coil section in a second winding area between the central circular rim and the outer circular rim of the second distal end, the first coil section and the second coil section being wound about the tubular coil holder in opposite directions;

wherein a first end and a second end of the single wire are arranged in the circular groove, the inner circular rim comprising a longitudinal groove to extend the first end and the second end of the single wire from the circular groove to the first winding area, the central circular rim comprising a longitudinal groove to extend the single wire form the first winding area to the second winding area and vice versa;

a tubular housing, the tubular housing having an inner diameter substantially equal to a diameter of the outer circular rim of the first distal end and a diameter of the outer circular rim of the second distal end;

an external connection comprising a first conductor and a second conductor, wherein an end of the first conductor is electrically connected to the first end of the single wire so as to form a first electrical connection arranged in the circular groove and an end of the second conductor is electrically connected to the second end of the single wire so as to form a second electrical connection in the circular groove, wherein the first and second conductor extend in a longitudinal direction through the outer circular rim via a longitudinal groove of the outer circular rim, and wherein the longitudinal groove of the outer circular rim and the longitudinal groove of the inner circular rim are disposed on opposite sides of the tubular coil holder such that the longitudinal groove of the outer circular rim is diametrically opposed to the longitudinal groove of the inner circular rim.

23. A method of manufacturing a coil assembly for a magnetic actuator, the method comprising the steps of:

providing a tubular coil holder comprising a first and second open distal end;

the first open distal end comprising an outer circular rim and an inner circular rim separated by a circular groove;

the second open distal end comprising an outer circular rim;

winding a coil formed of a single wire about the tubular coil holder, the coil being arranged in a winding area between the inner circular rim of the first open distal end and the outer circular rim of the second distal end;

providing an external connection comprising a first conductor and a second conductor;

connecting an end of the first conductor electrically to the first end of the single wire so as to form a first electrical connection;

connecting an end of the second conductor electrically to the second end of the single wire so as to form a second electrical connection;

arranging the first end and the second end of the single wire, the first and second electrical connection and the ends of the first and second conductors in the circular groove; and extending the first and second conductor in a longitudinal direction through the outer circular rim via a longitudinal groove of the outer circular rim, and wherein the inner circular rim comprises a longitudinal groove forming a passage from the circular groove to the winding area, and wherein the longitudinal groove of the outer circular rim and the longitudinal groove of the inner circular rim are disposed on opposite sides of the tubular coil holder such that the longitudinal groove of the outer circular rim is diametrically opposed to the longitudinal groove of the inner circular rim.

24. The method according to claim 23, further comprising the step of applying a heat shrink fitting to the circular groove, the heat shrink fitting being configured to clamp the first and second electrical connections in the circular groove.

25. The method according to claim 23, further comprising the step of injecting an impregnating or casting or potting compound into a space between the tubular coil holder and the tubular housing via a through hole of the outer circular rim of the second distal end or any other hole or opening in one or both distal ends.

26. A method of manufacturing a coil assembly for a magnetic actuator, the method comprising the steps of:

providing a tubular coil holder comprising a first and second open distal end, the first open distal end comprising an outer circular rim and an inner circular rim separated by a circular groove, the second open distal end comprising an outer circular rim, and the tubular coil holder further comprising a central circular rim arranged substantially halfway between the inner circular rim of the first open distal end and the outer circular rim of the second open distal end;

winding a coil formed of a single wire about the tubular coil holder, the coil comprising a first coil section arranged in a first winding area between the inner circular rim of the first open distal end and the central circular rim, and a second coil section in a second winding area between the central circular rim and the outer circular rim of the second distal end, the first coil section and the second coil section being wound about the tubular coil holder in opposite directions, and the single wire extending from the first winding area to the second winding area and vice versa via a longitudinal groove of the central circular rim;

providing an external connection comprising a first conductor and a second conductor;

connecting an end of the first conductor electrically to the first end of the single wire so as to form a first electrical connection;

connecting an end of the second conductor electrically to the second end of the single wire so as to form a second electrical connection;

arranging the first end and the second end of the single wire, the first and second electrical connection and the ends of the first and second conductors in the circular groove;

extending the first and second conductor in a longitudinal direction through the outer circular rim via a longitudinal groove of the outer circular rim, and mounting the tubular coil holder into a tubular housing, the tubular housing having an inner diameter substantially equal to a diameter of the outer circular rim of the first distal end and a diameter of the outer circular rim of the second distal end, wherein the inner circular rim comprises a longitudinal groove forming a passage from the circular groove to the first winding area, and wherein the longitudinal groove of the outer circular rim and the longitudinal groove of the inner circular rim are disposed on opposite sides of the tubular coil holder such that the longitudinal groove of the outer circular rim is diametrically opposed to the longitudinal groove of the inner circular rim.

27. A method of manufacturing a coil assembly for a magnetic actuator, the method comprising the steps of:

providing a tubular coil holder comprising a first and second open distal end, the first open distal end comprising an outer circular rim and an inner circular rim separated by a circular groove, the second open distal end comprising an outer circular rim, and the tubular coil holder further comprising one or more circular rims arranged between the inner circular rim of the first open distal end and the outer circular rim of the second open distal end;

winding a coil formed of a single wire about the tubular coil holder, the coil comprising a plurality of coil sections arranged in a respective plurality of winding areas between the inner circular rim of the first open distal end and the outer circular rim of the second distal end, coil sections in adjacent winding areas being wound about the tubular coil holder in opposite directions, the one or more circular rims comprising a respective one or more longitudinal grooves to extend the single wire from a winding area to the next winding area and vice versa;

providing an external connection comprising a first conductor and a second conductor;

connecting an end of the first conductor electrically to the first end of the single wire so as to form a first electrical connection;

connecting an end of the second conductor electrically to the second end of the single wire so as to form a second electrical connection;

arranging the first end and the second end of the single wire, the first and second electrical connection and the ends of the first and second conductors in the circular groove;

extending the first and second conductor in a longitudinal direction through the outer circular rim via a longitudinal groove of the outer circular rim; and mounting the tubular coil holder into a tubular housing; the tubular housing having an inner diameter substantially equal to a diameter of the outer circular rim of the first distal end and a diameter of the outer circular rim of the second distal end, wherein the inner circular rim comprises a longitudinal groove forming a passage from the circular groove to one of the plurality of winding areas, and wherein the longitudinal groove of the outer circular rim and the longitudinal groove of the inner circular rim are disposed on opposite sides of the tubular coil holder such that the longitudinal groove of the outer circular rim is diametrically opposed to the longitudinal groove of the inner circular rim.

* * * * *